US006698403B2

(12) United States Patent
Honda et al.

(10) Patent No.: US 6,698,403 B2
(45) Date of Patent: Mar. 2, 2004

(54) FUEL VAPOR ADSORPTION DEVICE OF INTERNAL COMBUSTION ENGINE AND METHOD OF DESORBING FUEL VAPOR FROM FUEL VAPOR ADSORBENT

(75) Inventors: Minoru Honda, Kariya (JP); Kouichi Oda, Kariya (JP); Naoya Kato, Ama-gun (JP); Masaki Takeyama, Okazaki (JP); Yoshinori Inuzuka, Okazaki (JP); Noriyasu Amano, Gamagori (JP); Takashi Nishimoto, Toyota (JP)

(73) Assignees: Toyoda Boshoku Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 10/241,444

(22) Filed: Sep. 12, 2002

(65) Prior Publication Data

US 2003/0056770 A1 Mar. 27, 2003

(30) Foreign Application Priority Data

Sep. 27, 2001 (JP) ..... 2001-297678

(51) Int. Cl.[7] ..... F02M 33/02
(52) U.S. Cl. ..... 123/520; 123/516; 123/557
(58) Field of Search ..... 123/557, 520, 123/518, 519, 521, 516

(56) References Cited

U.S. PATENT DOCUMENTS

| | | | | | |
|---|---|---|---|---|---|
| 5,349,934 | A | * | 9/1994 | Miyano | 123/519 |
| 5,482,023 | A | * | 1/1996 | Hunt | 123/491 |
| 5,482,024 | A | * | 1/1996 | Elliott | 123/516 |
| 5,931,141 | A | * | 8/1999 | Chino | 123/520 |
| 6,098,601 | A | * | 8/2000 | Reddy | 123/520 |
| 6,230,693 | B1 | * | 5/2001 | Meiller et al. | 123/519 |
| 6,279,548 | B1 | * | 8/2001 | Reddy | 123/520 |

FOREIGN PATENT DOCUMENTS

| | | |
|---|---|---|
| JP | U 62-184162 | 11/1987 |
| JP | A 9-96260 | 4/1997 |
| JP | A 11-82192 | 3/1999 |

* cited by examiner

*Primary Examiner*—Carl S. Miller
(74) *Attorney, Agent, or Firm*—Oliff & Berridge, PLC

(57) ABSTRACT

An absorbent, such as, for example, an active carbon, is provided in an intake air passage, for example, in an air cleaner, to efficiently adsorb fuel vapor. To ensure that fuel vapor adsorbed into the intake air passage can be efficiently desorbed even when there is only a small amount of the intake air, an intake throttle valve is provided upstream of the adsorbent and an opening of the intake throttle valve is throttled so as to decompress an area near the adsorbent. Desorption of fuel vapor also can be efficiently promoted by using a heater to directly heat the adsorbent in the intake air passage or by heating the intake air to indirectly heat the adsorbent.

14 Claims, 16 Drawing Sheets

FUEL VAPOR ADSORPTION DEVICE OF INTERNAL COMBUSTION ENGINE AND METHOD OF DESORBING FUEL VAPOR FROM FUEL VAPOR ADSORBENT

INCORPORATION BY REFERENCE

The disclosure of Japanese Patent Application No. 2001-297678 filed on Sep. 27, 2001, including the specification, drawings and abstract is incorporated herein by reference in its entirety.

BACKGROUND OF THE INVENTION

1. Field of Invention

The invention relates to a fuel vapor adsorption apparatus disposed in an intake air passage of an internal combustion engine in order to adsorb fuel vapor and a method of desorbing fuel vapor from a fuel vapor adsorbent.

2. Description of Related Art

As regulations on fuel vapor (hereinafter referred to as "HCs") discharged from a motor vehicle while the vehicle is stopped become more and more stringent, it has become a major issue that HCs diffuse and leak through an inlet port into the atmosphere while the vehicle is stopped. HCs are generated when residual fuel left in an engine and fuel that leaks from an injector vaporize. There has been devised a device, in which an HC adsorbent in the form of, for example, a filter accommodating an active carbon is disposed in a partial or entire surface of a cross section of an intake passage, such as an intake duct, an air cleaner, or the like, to adsorb HCs and thereby prevent HCs from leaking out through the intake port.

According to the device, the adsorbent is purged by air which is drawn in while the vehicle is operating such that HCs previously adsorbed while the vehicle was stopped are desorbed, thereby recovering the adsorption performance of the adsorbent. Thus, the adsorbent can effectively adsorb HCs when the vehicle is stopped the next time. However, the intake air may not be in uniform contact with the adsorbent and if the amount of the intake air is small depending on an operating state of the engine, HCs adsorbed by the adsorbent may not be completely purged. In this case, the adsorbent lacks a sufficient adsorption capacity when the vehicle is stopped the next time. As a result, HCs may leak through the intake port.

There is a known device as disclosed in Japanese Utility Model Laid-Open Publication No. 62-184162, in which an adsorbent provided in an air cleaner is heated to recover the adsorbent. However, since the arrangement has been devised for preventing icing, what is adsorbed by the adsorbent is water content in the air. The control of heating the adsorbent presented in this arrangement is not suited for the desorption of HCs as an object of the invention. Moreover, heating the adsorbent at all times aggravates fuel economy and should be avoided as much as possible.

SUMMARY OF THE INVENTION

The inventors have been paying attention to the fact that desorption of HCs adsorbed by an active carbon is promoted under a low pressure or a high temperature condition. At the time of desorption of HCs from the active carbon, HCs adsorbed through liquefaction are desorbed through vaporization. Desorption performance is therefore enhanced under a condition that allows HCs to vaporize easily (high temperature, low pressure). According to the invention, therefore, the desorption performance is enhanced by, reducing the pressure of the place in which the HC adsorbent is disposed, and/or heating the intake air or the HC adsorbent (it is desirable that the air or material be heated to a level of a typical boiling point of a fuel or higher) while the vehicle is operating (or during desorption). This approach makes it possible to efficiently desorb HCs from the adsorbent even with a small amount of air.

A first aspect of the invention relates to a fuel vapor adsorption apparatus of an internal combustion engine. The apparatus includes an adsorbent, disposed on at least a part of a cross section of an intake air passage of the internal combustion engine, that adsorbs fuel vapor, and an adjustment device, disposed upstream of the adsorbent in the intake air passage, that adjusts the amount of the intake air. The apparatus includes a controller that controls the adjustment device to place the adsorbent in a more vacuum condition than condition during an ordinary control of the internal combustion engine, under the same operating state but where fuel vapor is not being desorbed from the adsorbent, by regulating the amount of the intake air while a control is provided to desorb fuel vapor from the adsorbent.

As a result, by controlling the controller of the adjustment device (for example, an intake throttle valve), the adsorbent when purged, is placed in the more vacuum condition than a condition during the ordinary control where fuel vapor is not desorbed from the adsorbent, as compared to the internal combustion engine the same operation state, under but when description is not taking place. This promotes desorption of HCs.

A second aspect of the invention relates to a fuel vapor adsorption apparatus of an internal combustion engine. The apparatus includes an adsorbent, disposed in at least a part of a cross section of an intake air passage of the internal combustion engine, and a heading device. The adsorbent adsorbs fuel vapor. The heating device heats the adsorbent. The apparatus includes a controller that controls the heating device to adjust a heating amount for heating the adsorbent during a desorbing control of the internal combustion engine for desorbing fuel vapor from the adsorbent. The fuel vapor is described in accordance with the amount of the intake air passing through the intake air passage of the internal combustion engine.

In the second aspect, because the heating amount is controlled in accordance with the amount of the intake air passing through the intake air passage, it is possible to efficiently desorb HCs from the adsorbent.

A third aspect of the invention relates to a method of desorbing fuel vapor from an absorbent that adsorbs the fuel vapor and is disposed on at least part of a cross section of an intake air passage of an internal combustion engine. The method includes the step of determining whether a condition for desorbing fuel vapor from the adsorbent is met, and placing the adsorbent, if it is determined that the condition for desorbing fuel vapor from the adsorbent is met, in a more vacuum condition than during an ordinary control of the internal combustion engine under the same operating condition but where fuel vapor is not desorbed from the adsorbent.

In the third aspect, it is possible to efficiently desorb HCs from the adsorbent because the adsorbent is placed in the more vacuum condition if it is determined that the condition for desorbing fuel vapor from the adsorbent is met, than during the ordinary control of the internal combustion engine under the same operating state.

A fourth aspect of the invention relates to a method of desorbing fuel vapor from an adsorbent that adsorbs the fuel vapor and that is disposed on at least part of a cross section of an intake air passage of an internal combustion engine. The method includes the steps of determining whether a condition for desorbing fuel vapor from the adsorbent is met, determining an amount of the intake air required by the internal combustion engine, and increasing a heating amount for heating the adsorbent based on the determined amount of the intake air, if it is determined that the condition for desorbing fuel vapor from the adsorbent is met. The heating amount increases as the determined amount of the intake air decreases.

In the fourth aspect, because the heating amount is controlled in accordance of the intake air passing through the intake air passage, it possible to efficiently desorb HCs from the adsorbent.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS

Figure 1:
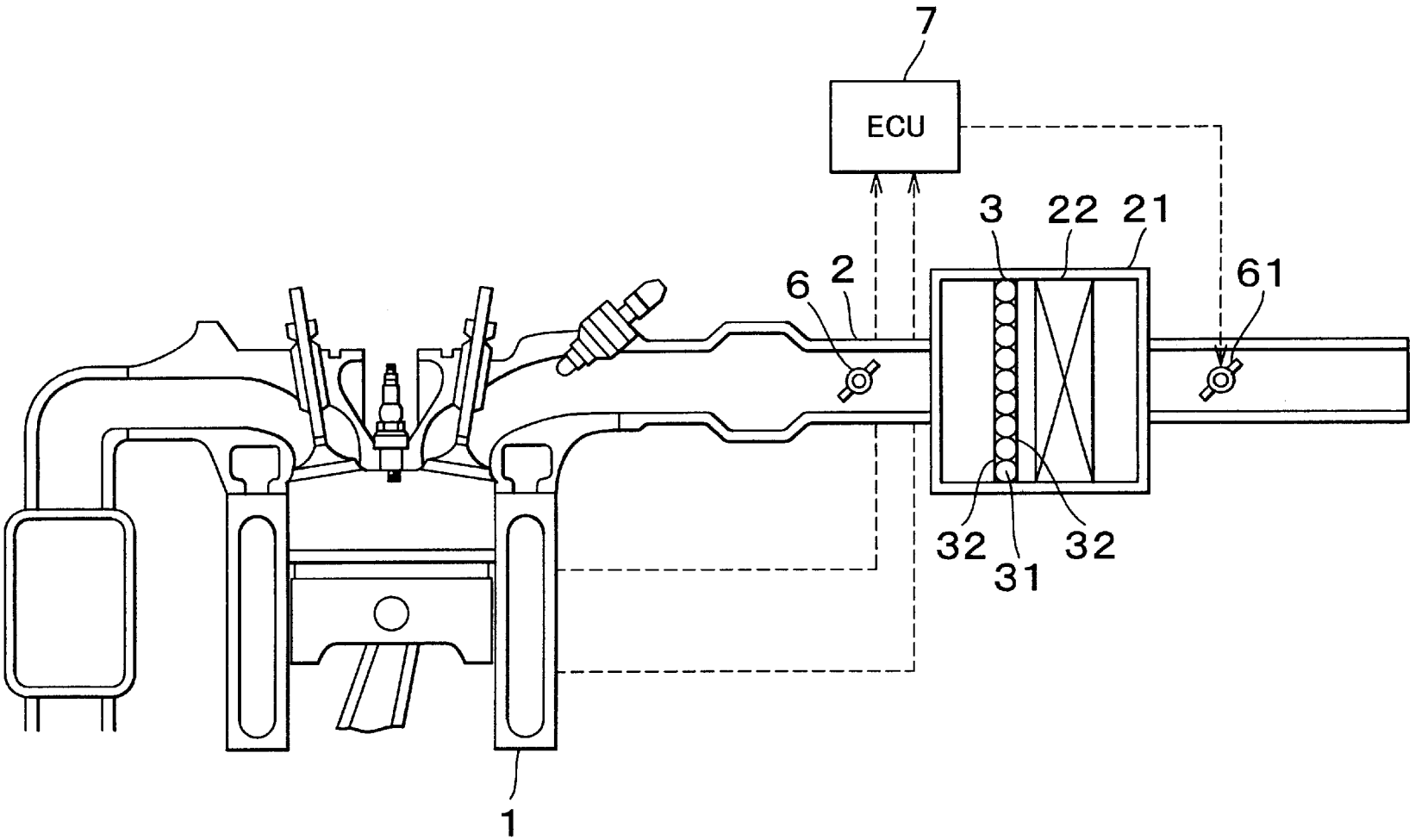
FIG. 1 is a system configuration diagram of a device according to a first embodiment of the invention.

The first embodiment according to the invention will be explained with reference to FIG. 1. An air cleaner 21 is installed in an intake pipe 2 of an internal combustion engine (engine) 1. The air cleaner 21 is provided therein with an air filter 22 having a function of filtering an intake air and an adsorption sheet 3 having a function of adsorbing HCs. The adsorption sheet 3 is disposed on a clean side of the air filter 22 (on a side of a main body of the engine 1) so as to prevent it from being plugged up by dust or other problem. The adsorption sheet 3 has a construction in which an adsorbent (for example, active carbon) 31 is sandwiched between two meshes 32. The mesh size of the mesh is set such that granular powders of the active carbon 31 do not drop through the mesh and the mesh meets an allowable pressure loss value. An intake throttle valve 61 regulates the amount of the intake air upstream of the air cleaner 21. The intake throttle valve 61 is set such at it does not, even when closed, make the intake pipe 2 airtight and thus allows air to flow therethrough so as to secure an amount of the intake air required when the engine 1 is operating at low revolution speeds or under low loads such that it ensures that there is a certain degree of vacuum in the areas around the adsorption sheet 3 which is located downstream of the intake throttle valve 61. An opening of the intake throttle valve 61 is controlled by an electronic control device (ECU) 7. An ordinary intake throttle valve 6 is provided downstream of the adsorption sheet 3.

The operation of the first embodiment according to the invention will be explained. HCs adsorbed onto the adsorption sheet 3 are easy to desorb if a condition that makes the HCs easy to vaporize is established. Therefore, if a vacuum is created in areas around the adsorption sheet 3, desorption of HCs will be promoted. The opening of the intake throttle valve 61 is therefore made small during purging, thereby allowing a vacuum to be created in areas around the adsorption sheet 3 downstream of the intake throttle valve 61 for promotion of desorption of HCs. As described earlier, when the engine is operating at low revolution speeds or under low loads, the amount of the intake air is small and HCs are hard to desorb. Control is therefore provided to close the intake throttle valve 61 such that a vacuum is created in areas around the adsorption sheet 3, thereby promoting desorption. As noted earlier, the opening of the intake throttle valve 61, when closed, is set so as to secure the amount of the intake air required when the engine is operating at low revolution speeds or under low loads. Therefore, closing of the intake throttle valve 61 has substantially no effect on the engine 1.

Since a large amount of the intake air is required when the engine is operating at high revolution speeds or under heavy loads, closing of the intake throttle valve 61 would inhibit intake of air, thus adversely affecting engine operations. The intake throttle valve 61 is therefore opened in such an operating state. At this time, there is a large amount of the intake air, which sets a condition, in which HCs are easy to desorb from the adsorption sheet 3. Therefore, it is possible for HCs to desorb satisfactorily even without a vacuum being created in areas around the adsorption sheet 3.

Figure 2:
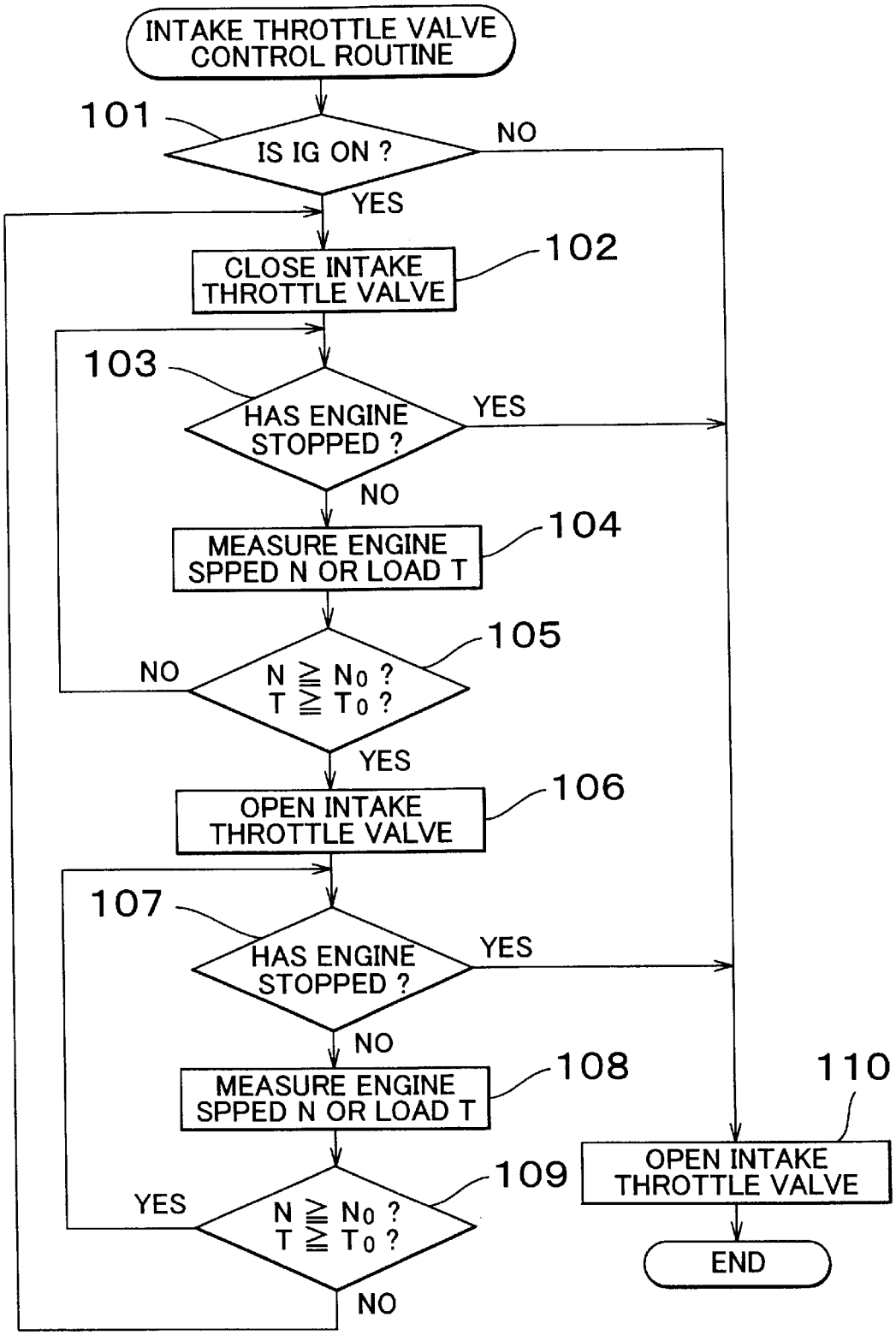
FIG. 2 is a flowchart showing a control routine according to the first embodiment of the invention.

A routine executed by the ECU 7 to control the intake throttle valve 61 in such a manner as described in the foregoing paragraphs will be explained with reference to the flowchart shown in FIG. 2. When it is determined that the engine 1 is started to operate as IG (ignition switch) is turned ON (step 101), control of the intake throttle valve 61 is started. Since the engine 1 is operating at low revolution speeds or under low loads at a timing immediately after the start, the intake throttle valve 61 is closed in step 102. It is then determined, in step 103, whether or not the engine 1 has stopped. If the engine 1 has stopped (Yes), the control proceeds to step 110, in which the intake throttle valve 61 is opened and control is terminated. If the engine 1 has not stopped (No), the control proceeds to step 104.

In step 104, an engine revolution speed N or a load T at the current time is measured/determined. The engine revolution speed N or load T is measured/determined, for example, by the revolution speed sensor of the engine 1, the opening of the intake throttle valve 6, signals indicating other engine operating states, and signals controlling the engine 1.

In subsequent step 105, it is determined whether or not the engine revolution speed N or the load T at the current timing is equal to or greater than predetermined values $N_0$ and $T_0$, respectively. If $N \geqq N_0$ (or $T \geqq T_0$) is not true (No), it is determined that the engine 1 is still operating at low revolution speeds or under low loads and the control returns to step 103.

If $N \geqq N_0$ (or $T \geqq T_0$) is true (Yes), it is determined that the engine 1 is operating at high revolution speeds or under heavy loads and the control proceeds to step 106, in which the intake throttle valve 61 is opened. In subsequent step 107, it is determined whether or not the engine 1 has stopped. If it is determined that the engine 1 has stopped (Yes), the control proceeds to step 110, in which the intake throttle valve 61 is opened and the control is terminated.

If it is determined that the engine 1 has not stopped (No), the control proceeds to step 108, in which the engine revolution speed N or the load T at the current timing is measured/determined by, for example, the revolution speed sensor of the engine 1, the opening of the intake throttle valve 6, signals indicating other engine operating states, signals controlling the engine 1.

In subsequent step 109, it is determined whether or not the engine revolution speed N or the load T at the current timing is equal to or greater than the predetermined values $N_0$ and $T_0$. If $N \geqq N_0$ (or $T \geqq T_0$) is true (Yes), it is determined that the engine 1 is still operating at high revolution speeds or under heavy loads and the control returns to step 107. If $N \geqq N_0$ (or $T \geqq T_0$) is not true (No), it is determined that the engine 1 is now operating at low revolution speeds or under low loads and the control returns to step 102.

The amount of air required by the engine 1 may be obtained based on the engine revolution speed N or the load T at the current timing measured/determined by, for example, the revolution speed sensor of the engine 1, the opening of the intake throttle valve 6, signals indicating other engine operating states, signals controlling the engine 1. The opening of the intake throttle valve 61 may be determined in accordance with the obtained required amount of air.

A variety of heating devices are available for heating the adsorbent, including a burning type heater that heats the intake air used for desorbing HCs through heating of the adsorbent, drawing in hot air, directly heating the adsorbent using a hot engine coolant, and an electrical heater heating the adsorbent. These devices are shown in FIGS. 3 through 6 and will be sequentially explained as a second embodiment through a fifth embodiment according to the invention. It is to be understood that the heating devices for the adsorbent are not limited to these arrangements and that heaters of other types may be used.

Figure 3:
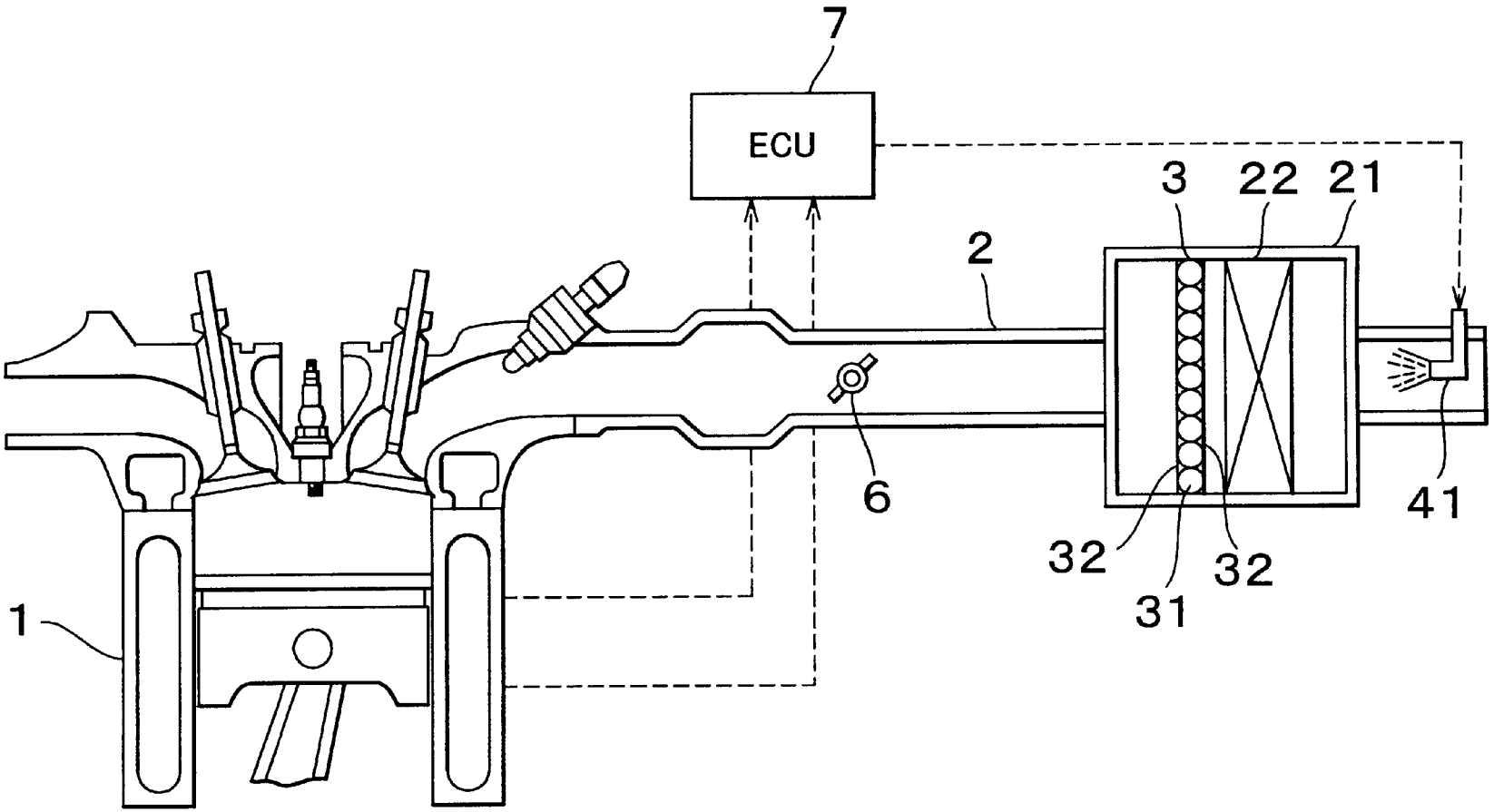
FIG. 3 is a system configuration diagram of a device according to a second embodiment of the invention.

A fuel vapor adsorption apparatus according to the second embodiment of the invention will be explained with reference to FIG. 3. An air cleaner 21 is installed in an intake pipe 2 of an engine 1. The air cleaner 21 is provided therein with an air filter 22 that filters intake air and an adsorption sheet 3 that adsorbs HCs. The adsorption sheet 3 is disposed on a clean side of the air filter 22 (on a side of a main body of the engine 1) so as to prevent it from being plugged up by dust or other problem. The adsorption sheet 3 has a construction in which an adsorbent (for example, active carbon) 31 is sandwiched between two meshes 32. The mesh size of the mesh 32 is set such that granular powders of the active carbon 31 do not drop through the mesh 32 and the mesh 32 meets an allowable pressure loss value. A burning type heater 41, as a specific example of a heating device for heating the adsorbent 31 by heating of the intake air, is disposed upstream of the air cleaner 21. The burning type heater 41 is disposed at a position, at which a flame thereof does not reach the air filter 22. Driving of the burning type heater 41 is controlled by an ECU 7.

The operation of the second embodiment according to the invention will be explained. When an air drawn in through an inlet port during an operation of the engine 1 moves through the air filter 22 and the adsorption sheet 3, part of HCs, adsorbed by the adsorbent 31 composed of active carbon, are purged by the air. When the burning type heater 41 is driven, the intake air is heated by the burning type heater 41, which increases the temperature of the air moving through the adsorption sheet 3. This helps make HCs adsorbed onto the adsorbent 31 easy to vaporize. As a result, desorption of HCs is promoted and it is possible to efficiently purge HCs with an amount of air smaller than when the intake air is not heated. It is more effective if the heating temperature of the burning type heater 41 is set so as to make the temperature of the intake air at a level of a typical boiling point of fuel (for example 60° C.) or higher.

As described earlier, HCs are hard to desorb, if no measure is taken, from the adsorbent 31 when the engine is operating at low revolution speeds or under low loads, as in the case with creating a certain degree of vacuum in areas around the adsorption sheet 3 downstream of the intake throttle valve 61 (the first embodiment). Therefore, according to the second embodiment of the invention, the burning type heater 41 is driven to heat the intake air, which promotes desorption of HCs.

On the contrary, HCs are easy to desorb when the engine is operating at high revolution speeds or under heavy loads, and therefore, in such conditions, the burning type heater 41 is stopped. In addition, the control according to the second embodiment has added values. For example, drawing in high temperature air under a condition of low loads promotes atomization of injected fuel flowing in the engine 1 and thus reduces exhaust emissions. Drawing in low temperature air under a condition of heavy loads improves charging efficiency for an increased power output. Further, the reduced intake air temperature suppresses self ignition, thus preventing knocking. The control according to the second embodiment is therefore advantageous also from the viewpoint of engine operations.

Figure 7:
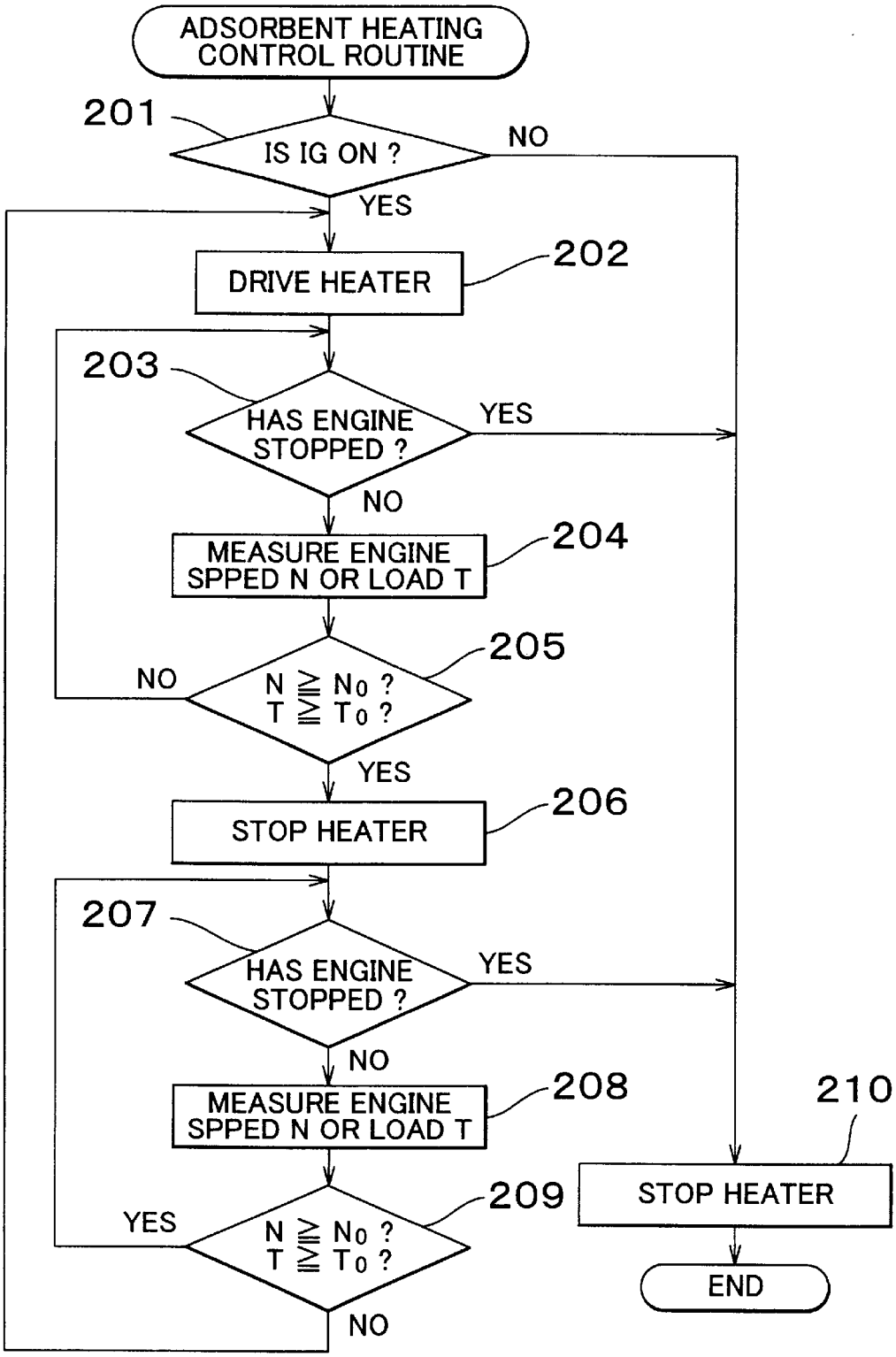
FIG. 7 is a flowchart showing a control routine according to the second embodiment and the fifth embodiment of the invention.

The control according to the second embodiment will be explained with reference to FIG. 7. When it is determined that operation of the vehicle is started as IG (ignition switch) is turned ON (in step 201), control of the burning type heater 41 is started. Since the engine 1 is operating at low revolution speeds or under low loads at a timing immediately after the start, the burning type heater 41 is driven in step 202.

In subsequent step 203, it is determined whether or not the engine 1 has stopped. If the engine 1 has stopped (Yes), the control proceeds to step 210, in which the burning type heater 41 is stopped and control is terminated. If the engine 1 has not stopped (No), the control proceeds to step 204, in which an engine revolution speed N or a load T at the current timing is measured/determined by, for example, the revolution speed sensor of the engine 1, the opening of the intake throttle valve 6, signals indicating other engine operating states, signals controlling the engine 1.

In subsequent step 205, it is determined whether or not the engine revolution speed N or the load T at the current timing is equal to or greater than the predetermined values $N_0$ and $T_0$, respectively. If $N \geqq N_0$ (or $T \geqq T_0$) is not true (No), it is determined that the engine 1 is still operating at low revolution speeds or under low loads and the control returns to step 203.

If $N \geqq N_0$ (or $T \geqq T_0$) is true (Yes), it is determined that the engine 1 is now operating at high revolution speeds or under heavy loads and the control proceeds to step 206, in which the burning type heater 41 is stopped. In subsequent step 207, it is then determined whether or not the engine 1 has stopped. If it is determined that the engine 1 has stopped (Yes), the control proceeds to step 210, in which the burning type heater 41 is stopped and the control is terminated. If it is determined that the engine 1 has not stopped (No), the control proceeds to step 208, in which the engine revolution speed N or the load T at the current timing is measured/determined by, for example, the revolution speed sensor of the engine 1, the opening of the intake throttle valve 6, signals indicating other engine operating states, signals controlling the engine 1.

In step 209, it is determined whether or not the engine revolution speed N or the load T at the current timing is equal to or greater than the predetermined values $N_0$ and $T_0$. If $N \geqq N_0$ (or $T \geqq T_0$) is true (Yes), it is determined that the engine 1 is still operating at high revolution speeds or under heavy loads and the control returns to step 207. If $N \geqq N_0$ (or $T \geqq T_0$) is not true (No), it is determined that the engine 1 is now operating at low revolution speeds or under low loads and the control returns to step 202.

Figure 4:
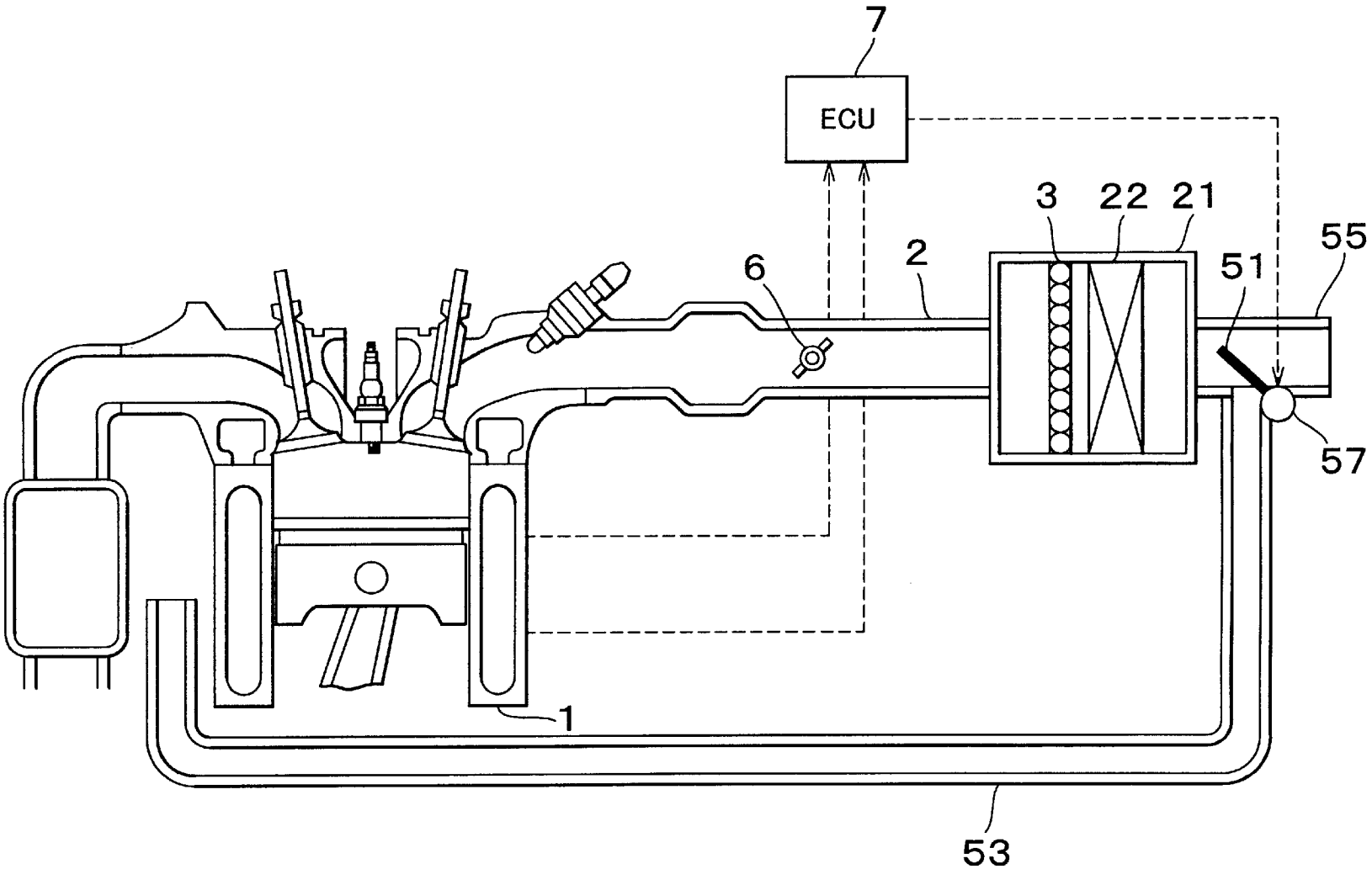
FIG. 4 is a system configuration diagram of a device according to a third embodiment of the invention.

A fuel vapor adsorption apparatus according to the third embodiment of the invention will be explained with reference to FIG. 4. According to the third embodiment, a hot air passage 53 is installed, with one end opened to an area around an engine 1 so as to take in hot air surrounding the engine 1 and the other end connected to an intake pipe 2 upstream of an air cleaner 21. Also, a selector valve 51 is installed at a connection portion between the hot air passage 53 and the intake pipe 2. The selector valve 51 is connected to a motor 57 that is driven as controlled by an ECU 7. For the sake of convenience, an intake pipe upstream of the selector valve 51 is called herein a cool air passage 55.

The operation of the third embodiment according to the invention will be explained. As evident from the foregoing descriptions, it is desirable that hot air be drawn in while the engine 1 is operating at low revolution speeds or under low loads and cool air be drawn in while the engine 1 is operating at high revolution speeds or under heavy loads. According to the third embodiment, therefore, the selector valve 51 is moved in a direction to open the hot air passage 53 when the engine 1 is operating at low revolution speeds or under low loads. This results in the hot air surrounding the engine 1 being drawn in, which promotes purging of an adsorption sheet 3. When the engine 1 is operating at high revolution speeds or under heavy loads, on the other hand, the selector valve 51 is moved in a direction to open the cool air passage 55. As a result, the cool air is drawn into the engine 1. However, since the amount of the intake air is large, the adsorption sheet 3 can be sufficiently purged even with the cool air.

Figure 8:
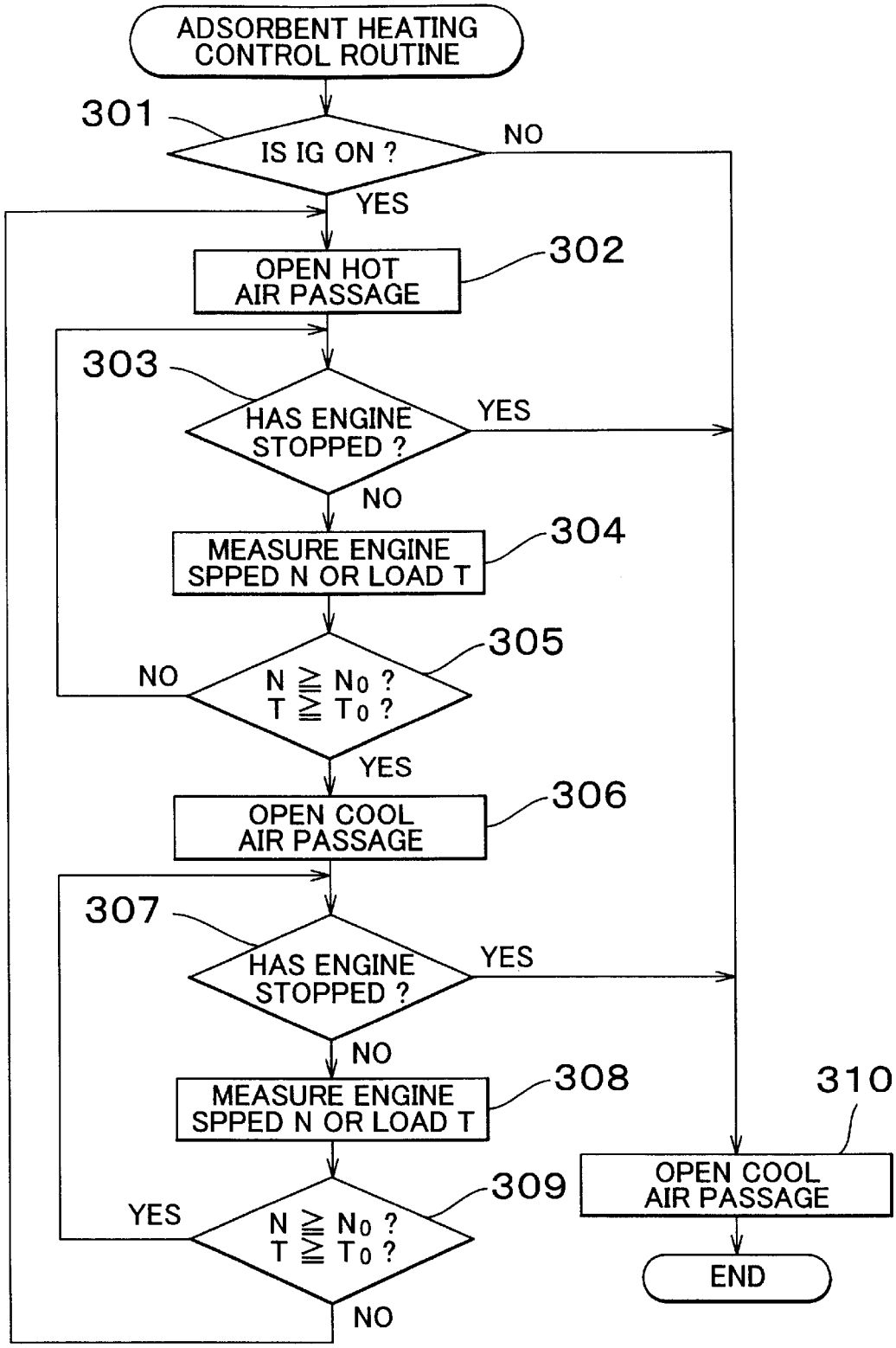
FIG. 8 is a flowchart showing a control routine according to the third embodiment of the invention.
Figure 9:
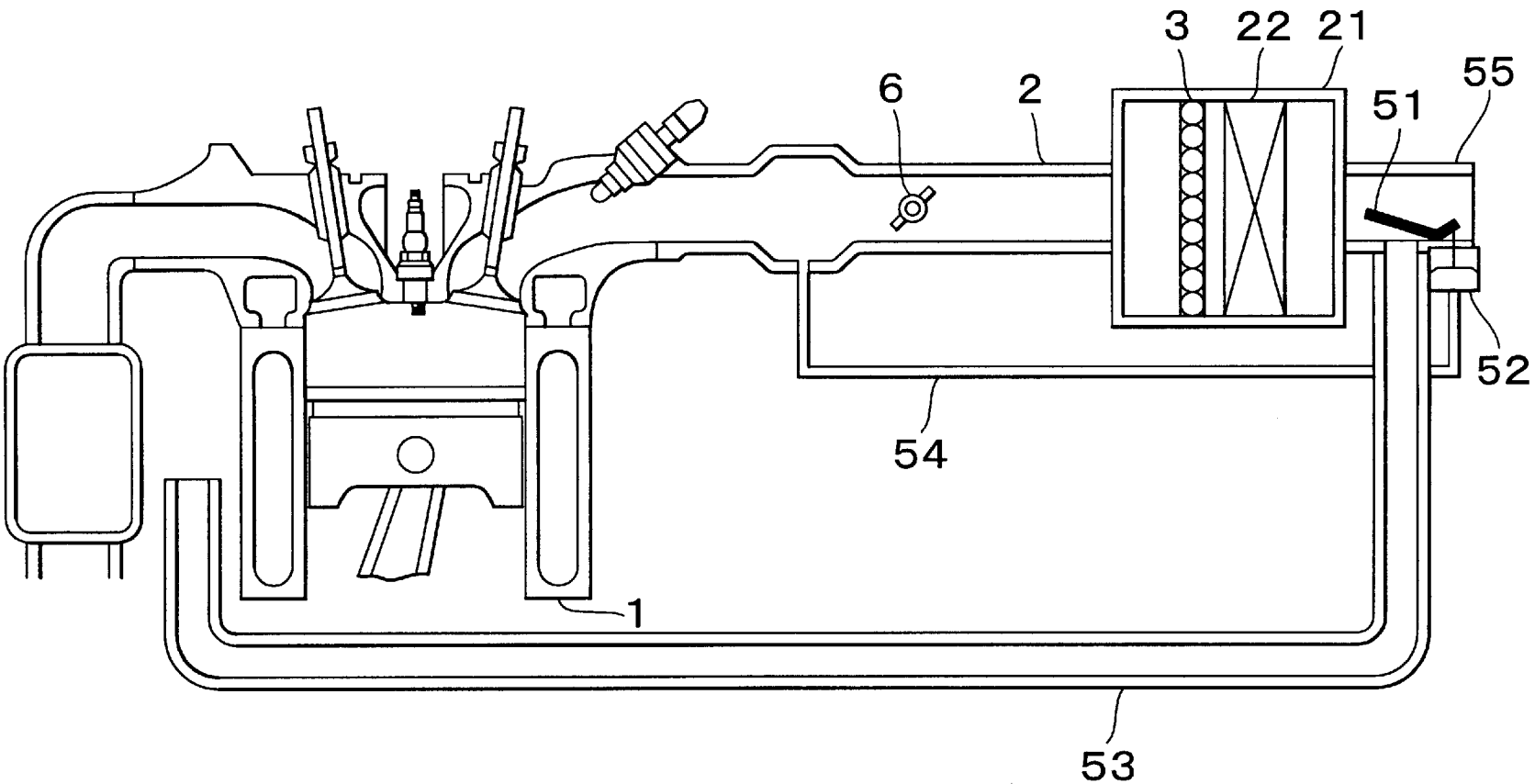
FIG. 9 is a system configuration diagram of a device as a modified example of the third embodiment of the invention.

The control according to the third embodiment is shown in FIG. 8. The steps shown in FIG. 8 are substantially the same as those shown in FIG. 7 that shows the control according to the second embodiment as described above, except that driving of the heater 41 in step 202 is replaced by opening of the hot air passage 53 in step 302 and that stopping of the heater 41 is replaced by opening of the cool air passage 55. When it is determined that the vehicle has been started as the result of IG being turned ON (in step 301), the selector valve 51 is moved in a direction to open the hot air passage 53 in step 302. If it is determined that $N \geqq N_0$ (or $T \geqq T_0$) is true (Yes) in step 305, it is determined that the engine 1 is now operating at high revolution speeds or under heavy loads and the control proceeds to step 306, in which the selector valve 51 is moved in a direction to open the cool air passage 55. Detailed explanations of FIG. 8 will be omitted. Though the motor 57 is used to drive the selector valve 51 in FIG. 4, an arrangement may be used as a modified example of the third embodiment as shown in FIG. 9, in which the selector valve 51 is driven by an actuator 52 that is operated by an intake pipe vacuum. In this case, the actuator 52 opens the hot air passage 53 when the engine 1 is operating at low revolution speeds or under low loads.

Figure 5:
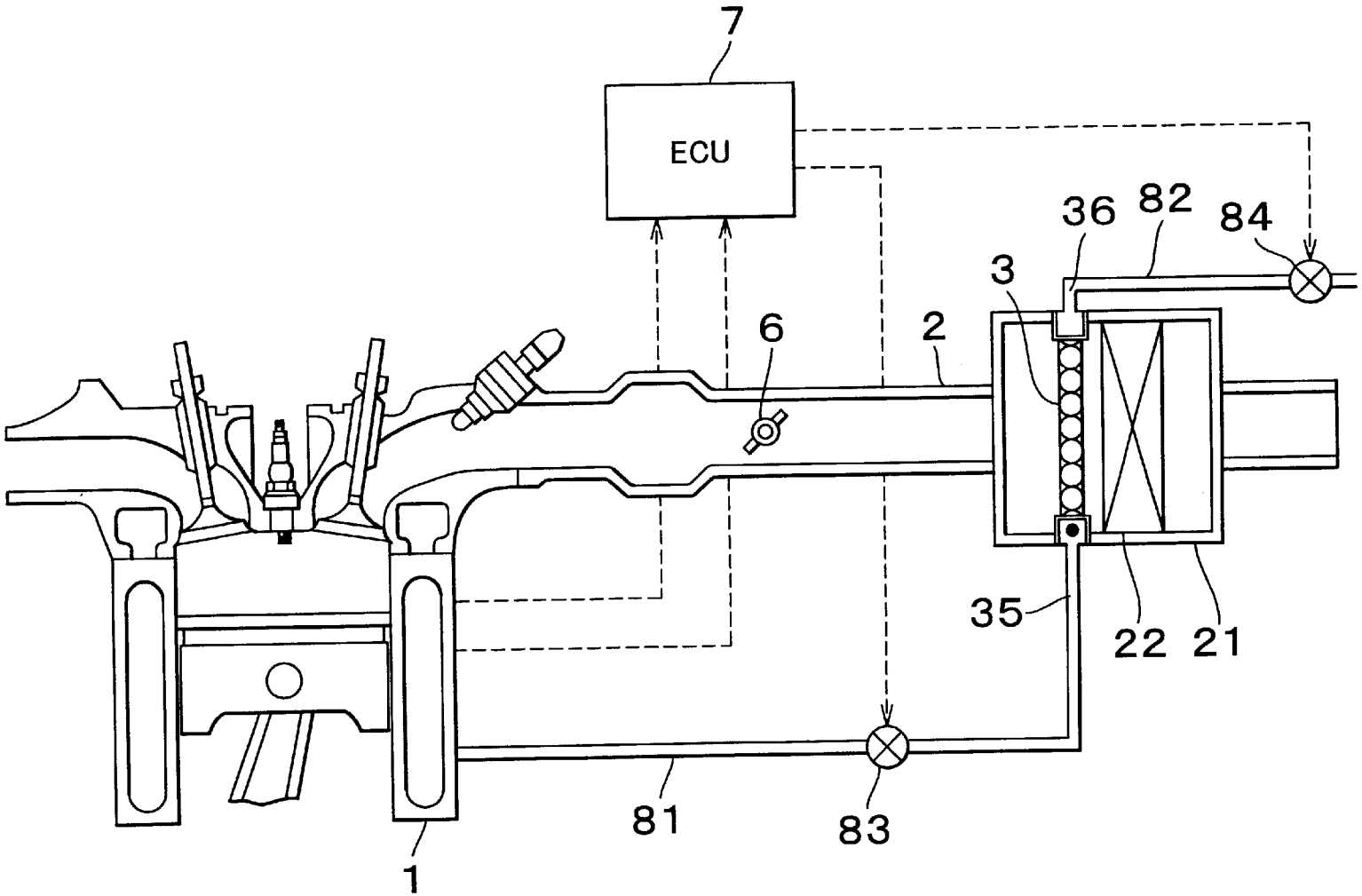
FIG. 5 is a system configuration diagram of a device according to a fourth embodiment of the invention.
Figure 10A:
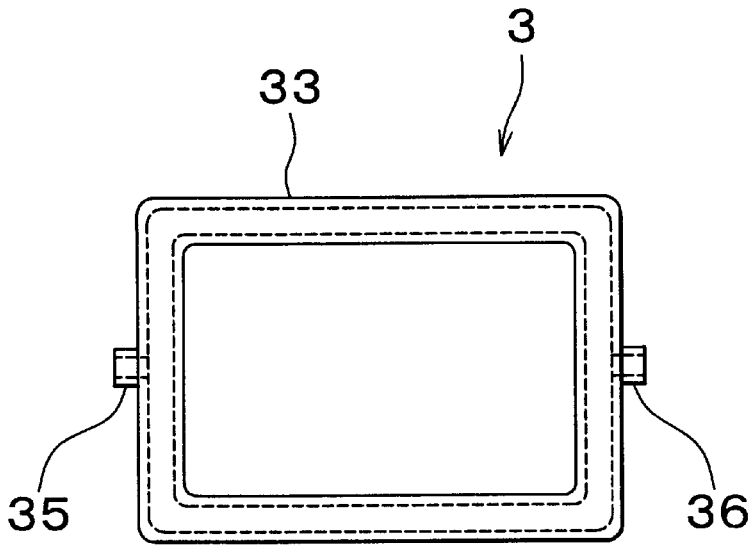
FIG. 10A is an enlarged front elevational view showing a principal part of the device according to the fourth embodiment of the invention.
Figure 10B:
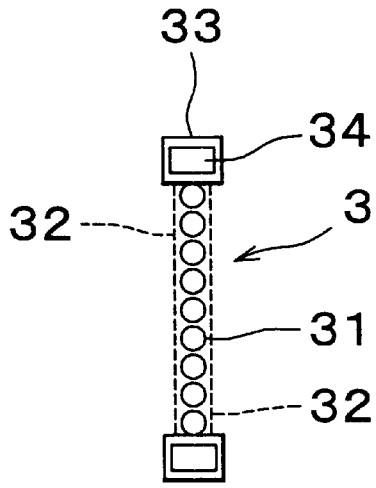
FIG. 10B is an enlarged side cross-sectional view showing a principal part of the device according to the fourth embodiment of the invention.

A fuel evaporate adsorption apparatus according to the fourth embodiment of the invention will be explained with reference to FIG. 5. In this arrangement, too, an air cleaner 21 is installed in an intake duct 2 of an engine 1 and the air cleaner 21 is provided therein with an air filter 22 that filters intake air and an adsorption sheet 3 that adsorbs HCs. FIGS. 10A and 10B show the construction of the adsorption sheet 3 that characterizes the fourth embodiment of the invention. The adsorption sheet 3 has a construction in which an adsorbent 31 (for example, an active carbon) that adsorbs HCs is sandwiched between two meshes 32, and fixed in position by mounting the sheets of the mesh 32 by way of a supporting frame 33 to the air cleaner 21.

The mesh size of the mesh 32 is set such that granular powders of the active carbon 31 do not drop through the mesh and the mesh meets an allowable pressure loss value. Inside the supporting frame 33, a water passage 34 is formed, connected to an outside by way of ports 35, 36 on both ends thereof. Referring to FIG. 5, the port 35 is connected to a water jacket of the engine 1 through a water passage 81. The port 36 is connected to a radiator (not shown) through a water passage 82. Valves 83 and 84 are provided in the middle of the water passages 81, 82 to cut off the water passages. The valves 83 and 84 are opened and closed as controlled by an ECU 7. It is good enough even if either the valve 83 or the valve 84 only is installed.

The operation of the fourth embodiment will be explained. As described earlier, it is desirable that high temperature air be drawn in while the engine 1 is operating at low revolution speeds or under low loads and low temperature air be drawn in while the engine 1 is operating at high revolution speeds or under heavy loads. Therefore, the engine revolution speed N or the load T at the current timing is measured as in the first embodiment, and valves 83, 84 are opened if the engine 1 is operating at low revolution speeds or under low loads. Since the coolant is hot enough to exceed a typical boiling point of fuel (for example 60° C.) under ordinary engine operating states, the adsorption sheet 3 is heated by the heat of the coolant. Moreover, the intake air is also heated as it passes through the adsorption sheet 3, which means that the engine 1 draws in high temperature air. If the engine 1 is operating at high revolution speeds or under heavy loads, the valves 83, 84 are closed. This stops heating the adsorption sheet 3 and thus the engine 1 draws in low temperature air.

Figure 11:
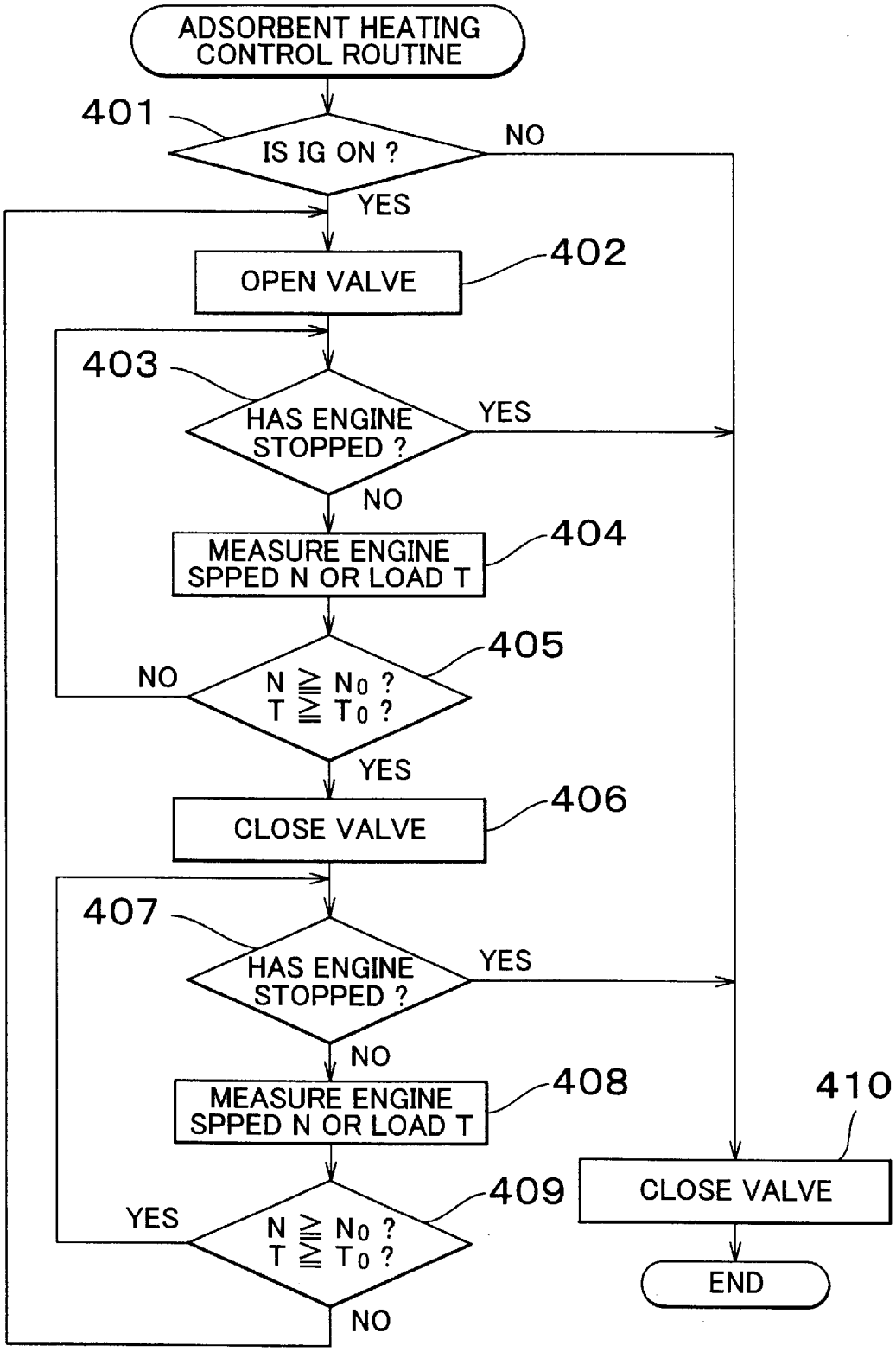
FIG. 11 is a flowchart showing a control routine according to the fourth embodiment of the invention.

FIG. 11 shows the control of the fourth embodiment according to the invention. The steps shown in FIG. 11 are substantially the same as those shown in FIG. 7 that shows the control according to the second embodiment, except that driving of the heater 41 is replaced by opening of the valves 83 and 84 and that stopping of the heater 41 is replaced by closing of the valves 83 and 84. Namely, when it is determined that the vehicle has been started as the result of IG being turned ON (in step 401), the valves 83 and 84 are opened in step 402 such that the adsorption sheet 3 is heated by the heat of the coolant. If it is determined that $N \geqq N_0$ (or $T \geqq T_0$) is true (Yes) in step 405, it is determined that the engine 1 is now operating at high revolution speeds or under heavy loads and the control proceeds to step 406, in which the valves 83 and 84 are closed. Detailed explanations of FIG. 11 will be omitted.

Figure 12A:
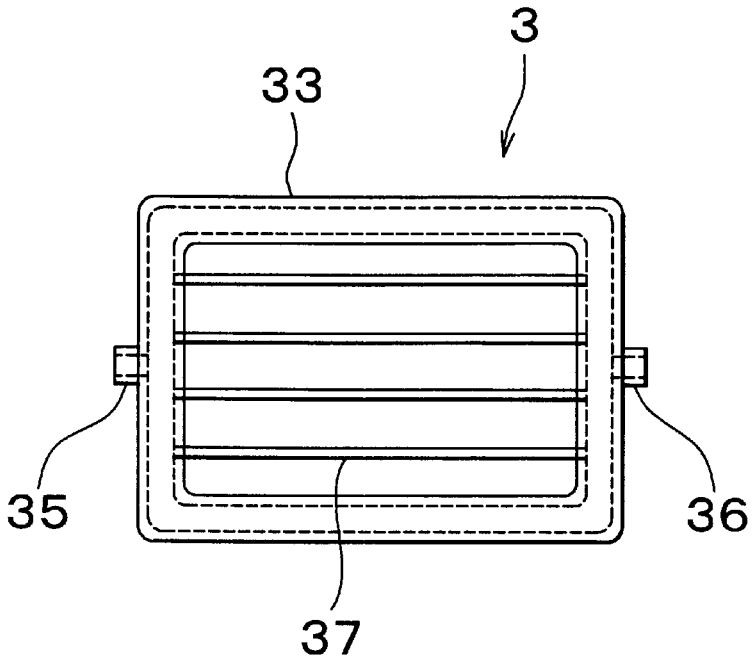
FIG. 12A is an enlarged front elevational view showing a principal part of a first modified example according to the fourth embodiment of the invention.
Figure 12B:
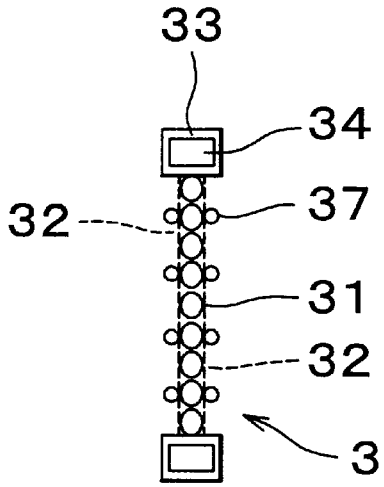
FIG. 12B is an enlarged side cross-sectional view showing a principal part of the first modified example according to the fourth embodiment of the invention.
Figure 13A:
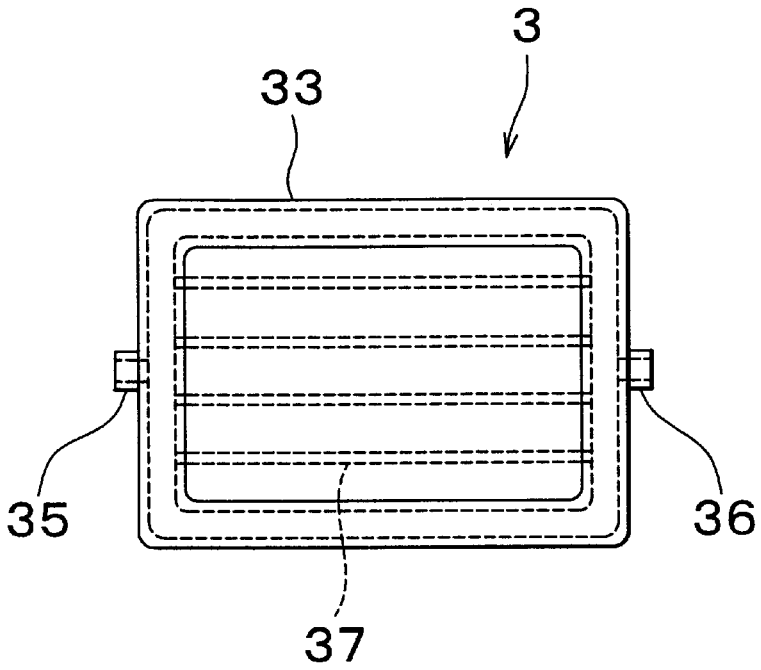
FIG. 13A is an enlarged front elevational view showing a principal part of a second modified example according to the fourth embodiment of the invention.
Figure 13B:
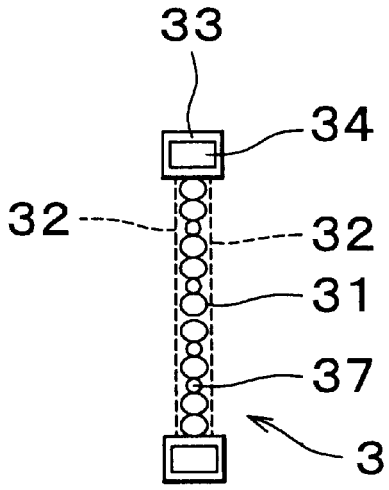
FIG. 13B is an enlarged side cross-sectional view showing a principal part of the second modified example according to the fourth embodiment of the invention.

Though a fuel evaporating adsorption apparatus according to the fourth embodiment has the arrangement, in which coolant flows through only the inside of the supporting frame 33, a water passage 37 can also be provided on a surface of the mesh 32 as in a first modified example of the fourth embodiment as shown in FIG. 12. A water passage can also be provided, for example, between active carbons 31 as in a second modified example of the fourth embodiment as shown in FIG. 13. This permits even more efficient temperature regulation for the active carbon 31 and intake air, thus leading to enhanced performance.

Figure 6:
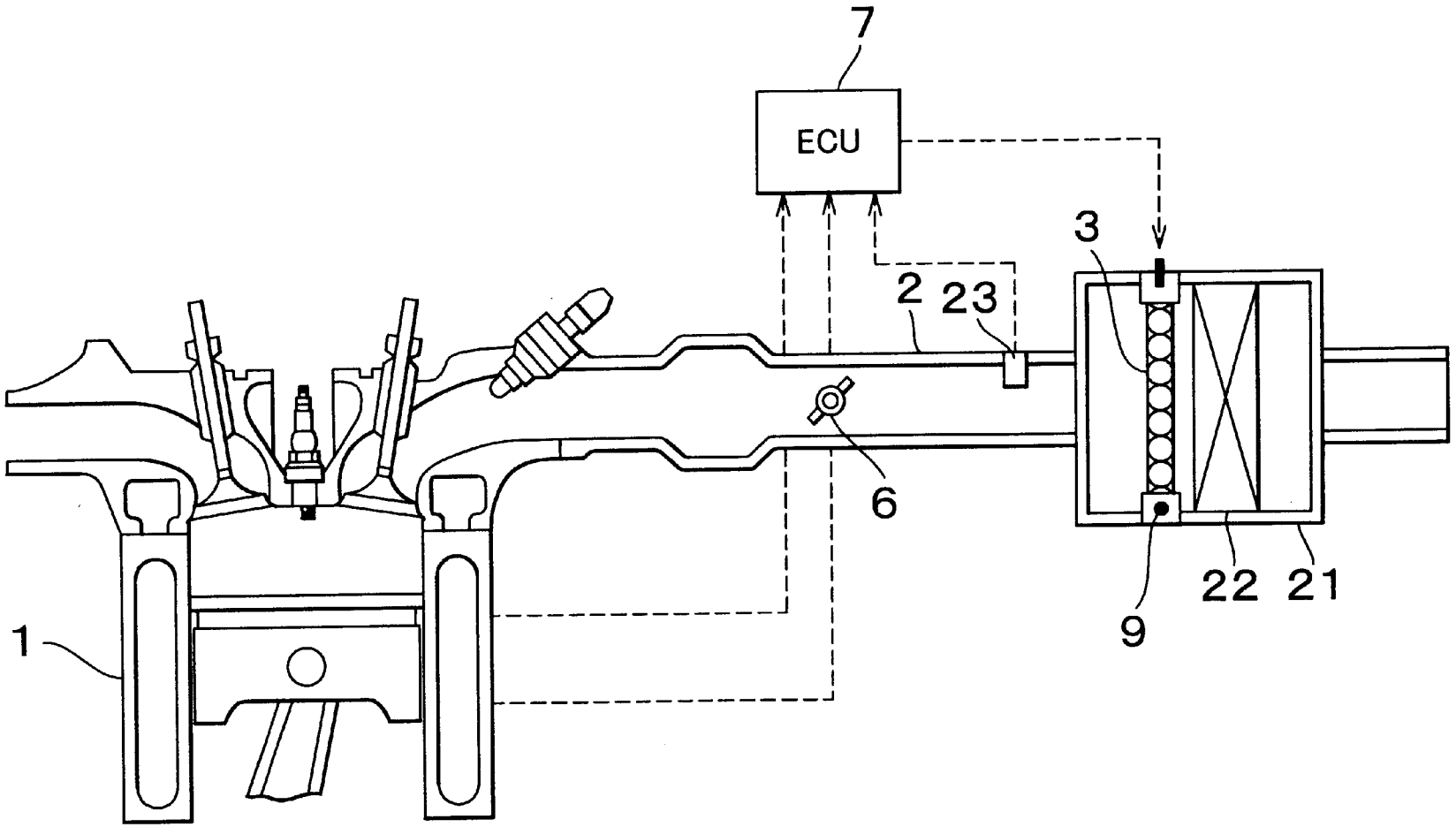
FIG. 6 is a system configuration diagram of a device according to a fifth embodiment of the invention.
Figure 14A:
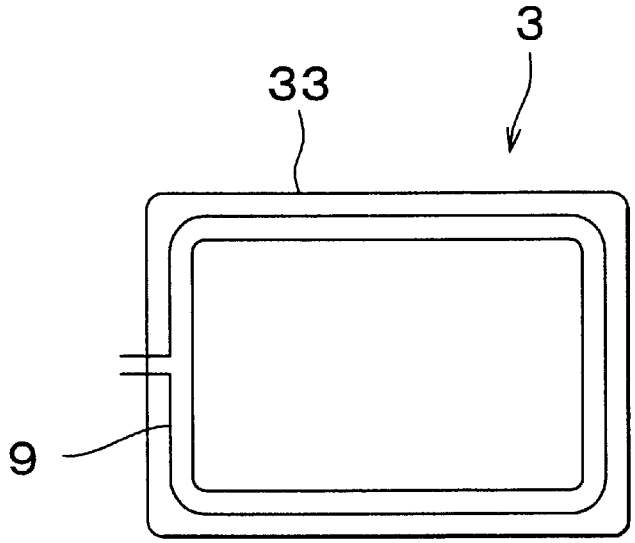
FIG. 14A is an enlarged front elevational view showing a principal part of the device according to the fifth embodiment of the invention.
Figure 14B:
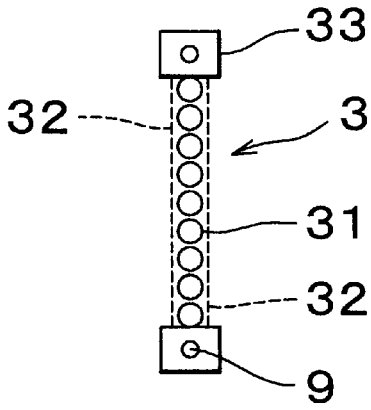
FIG. 14B is an enlarged side cross-sectional view showing a principal part of the device according to the fifth embodiment of the invention.

A fuel evaporate adsorption apparatus according to the fifth embodiment of the invention will be explained with reference to FIG. 6. An air cleaner 21 is installed in an intake duct 2 of an engine 1. The air cleaner 21 is provided therein with an air filter 22 that filters intake air and an adsorption sheet 3 that adsorbs HCs. FIGS. 14A and 14B show the specific construction of the adsorption sheet 3. An electrical heater 9 composed of a resistor wire is embedded inside a supporting frame 33 of the adsorption sheet 3. The heater 9 is energized so as to generate heat, thereby heating an active carbon 31. Driving of the heater 9 is controlled by an ECU 7. Installing the adsorption sheet 3 and the heater 9 inside the air cleaner 21 as described above makes it possible to build the entire fuel vapor adsorption apparatus compact.

The operation of the fifth embodiment according to the invention will be explained. As explained earlier, it is desirable that a high temperature air be drawn in when the engine 1 is operating at low revolution speeds or under low loads and a low temperature air be drawn in when the engine 1 is operating at high revolution speeds or under heavy loads. In the same manner as in the first embodiment according to the invention, an engine revolution speed N or a load T at the current timing is measured and, if it is found that the engine 1 is operating at low revolution speeds or under low loads, then the heater 9 is energized to heat the adsorption sheet 3. Moreover, since the intake air is heated as it passes through the heated adsorption sheet 3, the engine 1 draws in a high temperature air. If the engine 1 is operating at high revolution speeds or under heavy loads, the heater 9 is stopped. This stops heating the adsorption sheet 3, which results in the engine 1 drawing in low temperature air. The control routine for the heater 9 is the same as that for the second embodiment as shown in FIG. 7 and the corresponding flowchart and explanation will be omitted.

With the fifth embodiment according to the invention, too, it is possible to even more efficiently control the temperature of the adsorption sheet 3 by installing a heater on a surface of a mesh 32 and between active carbons 31 as shown in FIGS. 12A, 12B, 13A and 13B, showing modified examples of the fourth embodiment according to the invention, which allows performance to be enhanced.

Figure 15:
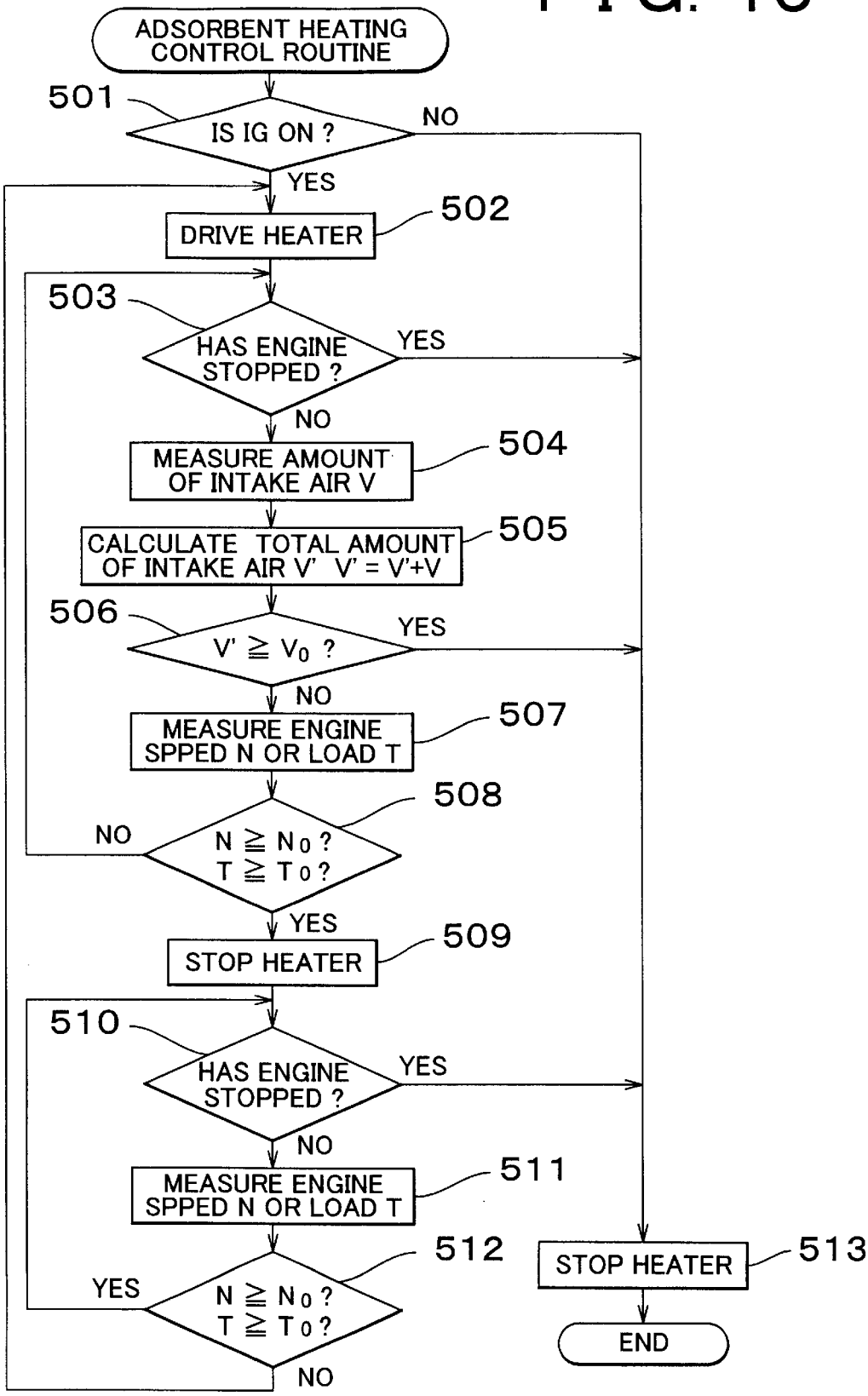
FIG. 15 is a flowchart showing a control routine according to the fifth embodiment of the invention.

When the heater is heated by an electric power as in the fifth embodiment according to the invention, reduced fuel economy results if the heater is kept energized at all times. It would be preferable if a control be added, with which the heater 9 is energized for only a period of time required for purging HCs from the adsorption sheet 3 and is stopped as soon as the purging of the adsorption sheet 3 is completed. FIG. 15 shows a flowchart, in which a control is provided by means of an output signal provided by an air flow sensor 23 installed in the intake pipe 2. An amount of the intake air required for purging HCs from the adsorption sheet 3 $V_0$ is determined by adsorption performance and desorption performance of the adsorption sheet 3 and a calorific value of the heater 9 (or the temperature of the adsorption sheet 3 when heated).

If it is determined that the engine 1 has started operating as a result of IG being turned ON (Yes) (in step 501), the energization control of the heater 9 is started. Since the engine 1 is operating at low revolution speeds or under low loads immediately after the start, the heater 9 is energized in step 502. In step 503, it is then determined whether or not the engine 1 has stopped. If it is determined that the engine 1 has stopped (Yes), the control proceeds to step 513, in which current supply to the heater 9 is cut off and the control is terminated. If it is determined that the engine 1 has not stopped (No), the control proceeds to step 504, in which the amount of the intake air V is obtained from the output signal supplied by the air flow sensor 23.

In step 505, a cumulative amount of the intake air V' since the control was started is obtained. In subsequent step 506, it is determined whether or not the cumulative amount of the intake air V' reaches the required amount of the intake air $V_0$. If it is determined that $V' \geqq V_0$ is true (Yes), it is considered that the purging of the adsorption sheet 3 is completed and the control proceeds to step 513, in which the current supply to the heater 9 is cut off and the control is terminated.

If it is determined that $V' \geqq V_0$ is not true (No), it is determined that the purging of the adsorption sheet 3 is not completed and the control proceeds to step 507. In step 507, an engine revolution speed N or a load T at the current timing is measured by a revolution speed sensor of the engine 1, signals indicating engine operating states, signals controlling the engine 1, and the like. In step 508, it is determined whether or not the engine revolution speed N or the load T at the current timing is equal to or greater than predetermined values $N_0$ and $T_0$, respectively. If $N \geqq N_0$ (or $T \geqq T_0$) is not true (No), it is determined that the engine 1 is still operating at low revolution speeds or under low loads and the control returns to step 503. If $N \geqq N_0$ (or $T \geqq T_0$) is true (Yes), it is determined that the engine 1 is operating at high revolution speeds or under heavy loads and the control proceeds to step 509, in which current supply to the heater 9 is cut off.

In step 510, it is determined whether or not the engine 1 has stopped. If it is determined that the engine 1 has stopped (Yes), the control proceeds to step 513, in which current supply to the heater 9 is cut off and the control is terminated. If it is determined that the engine 1 has not stopped (No), the control proceeds to step 511, in which the engine revolution speed N or the load T at the current timing is measured by a revolution speed sensor of the engine 1, signals indicating engine operating states, signals controlling the engine 1, and the like. In step 512, it is determined whether or not the engine revolution speed N or the load T at the current timing is equal to or greater than predetermined values $N_0$ and $T_0$, respectively. If $N \geqq N_0$ (or $T \geqq T_0$) is true (Yes), it is determined that the engine 1 is still operating at high revolution speeds or under heavy loads and the control returns to step 510. If $N \geqq N_0$ (or $T \geqq T_0$) is not true (No), it is determined that the engine 1 is now operating at low revolution speeds or under low loads and the control returns to step 502. This control applies also to each of the first through fifth embodiments.

The control routine shown in FIG. 15 is an example of a type of control that is based on only the amount of the intake air available for a period of time while the heater 9 is being energized, during which the adsorption sheet 3 is heated. However, HCs are purged also for a period of time during which the adsorption sheet 3 is not heated.

Figure 16:
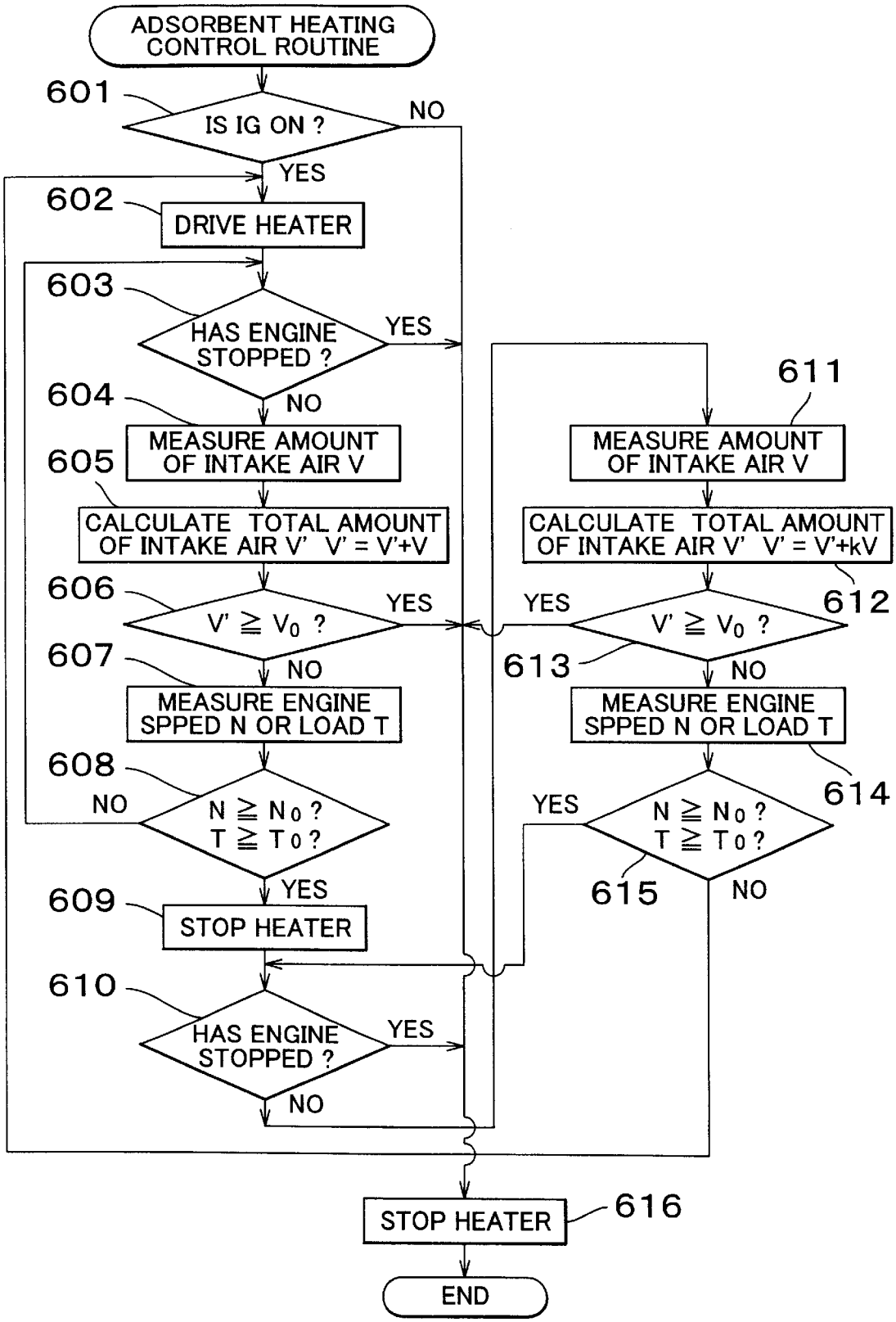
FIG. 16 is a flowchart showing a modified example of the control routine according to the fifth embodiment of the invention.

A control routine, which takes into account this fact, is shown in FIG. 16. Steps 601–610 are exactly the same as steps 501–510 in FIG. 15. A difference of the control routine shown in FIG. 16 from that shown in FIG. 15 is the portion of steps 611–613, particularly step 612. The adsorption sheet 3 offers different desorption performance between when it is heated and when it is not heated. Namely, to ensure that the same amount of HCs is to be desorbed, a greater amount of the intake air is required when the adsorption sheet 3 is not heated than when it is heated. A coefficient k indicating the effect of whether or not the adsorption sheet is heated is obtained in advance and considered (step 612) when finding the cumulative amount of the intake air V' when the adsorption sheet is not heated.

Explanations in greater detail will be omitted, since the rest of the routine steps are the same as those shown in FIG. 15. It is also effective if this control routine is applied to each of the first through fifth embodiments according to the invention.

After the purging of the adsorption sheet 3 has been completed, control may be shifted to an ordinary control for the engine 1, different from the control to desorb fuel vapor from the adsorbent 31.

In each of the different embodiments according to the invention as shown in the accompanying drawings, the adsorbent 31 such as the active carbon is held in the adsorption sheet 3 housed in the air cleaner 21. In a fuel vapor adsorption apparatus according to the invention, the adsorbent 31 may be disposed at a position, other than a position inside the air cleaner 21, for example, downstream of the air cleaner 21 inside the intake pipe 2 and upstream of the ordinary intake throttle valve 6. In addition, if an arrangement allows the adsorbent 31 to be directly heated by the heater 9 or coolant, the adsorbent 31 may be disposed downstream of the intake throttle valve 6.

An arrangement is also possible, in which the engine revolution speed N or the load T at the current timing is measured/determined by, for example, the revolution speed sensor of the engine 1, the opening of the intake throttle valve 6, signals indicating other engine operating states, signals controlling the engine 1. Based on the engine revolution speed N or the load T, the calorific value for the adsorbent sheet 3 (or the adsorbent 31) is controlled.

The ECU 7 and the actuator 52 can be regarded as examples of a controller for the invention.

In the illustrated embodiment, the apparatus is controlled a controller, which is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A fuel vapor adsorption apparatus of an internal combustion engine, comprising:

an adsorbent, disposed in at least a part of a cross section of an intake air passage of the internal combustion engine, that adsorbs fuel vapor;

a heater that heats the adsorbent; and a controller that controls the heater to adjust a heating amount for heating the adsorbent during a desorbing control of the internal combustion engine for desorbing fuel vapor from the adsorbent in accordance with an amount of intake air passing through the intake air passage of the internal combustion engine, wherein the controller controls the heater in accordance with the operating state of the internal combustion engine and the controller operates the heater only in at least one of a case where the revolution speed of the internal combustion engine is smaller than a first predetermined value and a case where the load of the internal combustion engine is smaller than a second predetermined value.

2. A fuel vapor adsorption apparatus of an internal combustion engine, comprising:

an adsorbent, disposed in at least a part of a cross section of an intake air passage of the internal combustion engine, that adsorbs fuel vapor;

an adjustment device that is disposed upstream of the adsorbent in the intake air passage and that adjusts an amount of the intake air; and a controller that controls the adjustment device to place the adsorbent in a more vacuum condition during a desorbing control than a condition during an ordinary control of the internal combustion engine, under the same operating state, but where fuel vapor is not being desorbed from the adsorbent, by regulating the amount of the intake air during the desorbing control of the internal combustion engine for desorbing fuel vapor from the adsorbent.

3. The fuel vapor adsorption apparatus according to claim 2, wherein the controller controls a magnitude of vacuum acting on the adsorbent by operating the adjustment device according to the operating state of the internal combustion engine.

4. The fuel vapor adsorption apparatus according to claim 2, wherein the adjustment device is an intake throttle valve that is different from an intake throttle valve operated during the ordinary control of the internal combustion engine.

5. The fuel vapor adsorption apparatus according to claim 2, wherein the controller controls the adjustment device during the desorbing control, such that the smaller the amount of the intake air required by the internal combustion engine, the stronger the vacuum condition created for the adsorbent.

6. The fuel vapor adsorption apparatus according to claim 5, wherein the controller determines at least one of whether a speed of the internal combustion engine is smaller than a first predetermined value and whether a load of the internal combustion engine is smaller than a second predetermined value, and controls the adjustment device so as to place the adsorbent in the more vacuum condition in at least one of a case where the speed of the internal combustion engine is smaller than the first predetermined value and a case where the load of the internal combustion engine is smaller than the second predetermined value, as compared with a condition in at least one of a case where the speed of the internal combustion engine is equal to or greater than the first predetermined value and a case where the load of the internal combustion engine is equal to or greater than the second predetermined value.

7. A fuel vapor adsorption apparatus of an internal combustion engine, comprising:

an adsorbent, disposed in at least a part of a cross section of an intake air passage of the internal combustion engine, that adsorbs fuel vapor;

a heater that heats the adsorbent; and a controller that controls the heater to adjust a heating amount for heating the adsorbent during a desorbing control of the internal combustion engine for desorbing fuel vapor from the adsorbent in accordance with an amount of intake air passing through the intake air passage of the internal combustion engine, wherein the heater is disposed upstream of the adsorbent and heats the intake air, the controller controls the heater during the desorbing control such that the adsorbent is heated by heating the intake air, and the heater includes a burning type heater.

8. The fuel vapor adsorption apparatus according to claim 6, wherein the controller stops operation of the heater when desorption of the fuel vapor from the adsorbent is completed as a result of the operation of the heater.

9. The fuel vapor adsorption apparatus according to claim 8, further comprising:

a detector that detects the amount of the intake air, wherein the controller determines that desorption of the fuel vapor from the adsorbent is completed if a total amount of the intake air during the desorbing control as obtained from the amount of the intake air detected by the detector is equal to or greater than a predetermined value.

10. The fuel vapor adsorption apparatus according to claim 9, wherein the total amount of the intake air is a total of a first value obtained from a first amount of the intake air that is not heated and a second value obtained from a second amount of the intake air that is heated; and the first value and the second value are obtained through calculations that are different from each other and that take into account whether the intake air is heated.

11. The fuel vapor adsorption apparatus according to claim 6, wherein, the smaller the amount of the intake air required by the internal combustion engine, the greater the controller increases the heating amount for heating the adsorbent during the desorbing control.

12. The fuel vapor adsorption apparatus according to claim 11, wherein the controller determines at least one of whether a speed of the internal combustion engine is smaller than the first predetermined value and whether a load of the internal combustion engine is smaller than the second predetermined value, and controls the heater so as to heat the adsorbent more in at least one of a case where the speed of the internal combustion engine is smaller than the first predetermined value and a case where the load of the internal combustion engine is smaller than the second predetermined value, as compared with the condition in at least one of a case where the speed of the internal combustion engine is equal to or greater than the first predetermined value and a case where the load of the internal combustion engine is equal to or greater than the second predetermined value.

13. A method of desorbing fuel vapor from an adsorbent that adsorbs the fuel vapor and is disposed in at least part of a cross section of an intake air passage of an internal combustion engine, comprising:

determining whether a condition for desorbing fuel vapor from the adsorbent is met; and placing the adsorbent, if it is determined that the condition for desorbing fuel vapor from the adsorbent is met, in a more vacuum condition than a condition during an ordinary control of the internal combustion engine, under the same operating conditions, but where fuel vapor is not being desorbed from the adsorbent.

14. A method of desorbing fuel vapor from an adsorbent that adsorbs the fuel vapor and that is disposed in at least part of a cross section of an intake air passage of an internal combustion engine, comprising:

determining whether a condition for desorbing fuel vapor from the adsorbent is met;

determining an amount of the intake air required by the internal combustion engine; and increasing a heating amount for heating the adsorbent based on the determined amount of the intake air, if it is determined that the condition for desorbing fuel vapor from the adsorbent is met, wherein the heating amount increases as the determined amount of the intake air decreases.

* * * * *